US006352308B1

(12) United States Patent
Chen

(10) Patent No.: US 6,352,308 B1
(45) Date of Patent: Mar. 5, 2002

(54) SUPPORT FRAME DEVICE FOR CONNECTING A SEAT PORTION TO AN UPRIGHT POST

(76) Inventor: Su-Ming Chen, No. 566, Fong-Lin 2nd Rd., Ta-Liao, Hsiang, Kaohsiung Hsien (TW)

( * ) Notice: Subject to any disclaimer, the term of this patent is extended or adjusted under 35 U.S.C. 154(b) by 8 days.

(21) Appl. No.: 09/611,154

(22) Filed: Jul. 6, 2000

(51) Int. Cl.[7] ..... A47C 1/02

(52) U.S. Cl. ..... 297/344.21; 297/344.19; 297/463.1; 248/188.1; 248/404; 248/418

(58) Field of Search ..... 297/344.18, 344.19, 297/344.2, 344.21, 344.22, 300.2, 300.3, 302.1, 463.1, 344.12; 248/415, 418, 404, 405, 157, 188.1; 108/103

(56) References Cited

U.S. PATENT DOCUMENTS 2,740,464 A * 4/1956 Hamilton ..... 297/344.12
2,921,623 A * 1/1960 Humphries et al. .... 297/344.12
3,547,394 A * 12/1970 Wehner ..... 248/414
3,593,954 A * 7/1971 Ritchle ..... 248/415
4,226,398 A * 10/1980 Freber ..... 248/415
4,915,449 A * 4/1990 Piretti ..... 297/326
5,630,649 A * 5/1997 Heidmann et al. ..... 297/344.19
6,022,077 A * 2/2000 Kirkland et al. ..... 297/344.19
6,120,096 A * 9/2000 Miotto ..... 297/301.4
6,131,997 A * 10/2000 Cao ..... 297/344.22
6,290,296 B1 * 9/2001 Beggs ..... 297/344.16

* cited by examiner

*Primary Examiner*—Winnie S. Yip
(74) *Attorney, Agent, or Firm*—Merchant & Gould P.C.

(57) ABSTRACT

A support frame device for connecting a seat portion to an upright post includes a base mounting plate with right and left anchoring plates secured to right and left anchored plates of a spacer plate, respectively. An annular stiffening member has an annular abutment end abutting against a lower peripheral edge portion of the spacer plate. A hollow stem with an upper flange portion is extended through a post mounting bore in the spacer plate and an axial passage of the stiffening member such that the flange portion abuts against an upper peripheral edge portion of the spacer plate. An annular lower end of the stem is then malleated to form a flared portion that abuts against a lower end of the stiffening member.

4 Claims, 6 Drawing Sheets

SUPPORT FRAME DEVICE FOR CONNECTING A SEAT PORTION TO AN UPRIGHT POST

BACKGROUND OF THE INVENTION

1. Field of the Invention

The invention relates to a support frame device for connecting a seat portion to an upright post, more particularly to a support frame device that is convenient to assemble and that has good structural strength.

2. Description of the Related Art

A conventional office chair generally includes a swivel base with an upright post connected to a seat portion so as to permit swiveling and easy removal thereof. The upright post is connected to the seat portion via a support frame device. For purposes of height adjustment, an upper end of the upright post is provided with a retractable pneumatic rod that extends into the support frame device. As the load borne by the chair is transferred to the upright post via the support frame device, there is a concentration of stress on the support frame device. In order to have sufficient supporting strength, the support frame device has to be formed from metal materials of preferred strength.

FIG. 1 shows a conventional support frame device 1, which includes a base mounting plate 11 adapted to be mounted beneath a seat portion (not shown), and a spacer plate 12 disposed on a bottom portion of the base mounting plate 11 and formed with a through hole 121. Both of the base mounting plate 11 and the spacer plate 12 are formed from a metal material. A post mounting member 122 has a periphery welded to a bottom portion of the spacer plate 12, and is formed with an upwardly tapered hollow stem 123 that is aligned with the through hole 121. An upright post 14 of a swivel base (not shown) is inserted via the hollow stem 123 through the through hole 121 to be retained in the hollow stem 123 and the spacer plate 12. The post mounting member 122 is formed from a metal material of preferred strength in order to enhance the structural strength of the device 1. One problem with the conventional support frame device 1 resides in that the process of welding the post mounting member 122 to the spacer plate 12 is troublesome. In addition, the welded parts may become brittle due to carbonization of the metal material thereof, and may consequently break upon prolonged application of shear forces generated by loads borne thereby.

FIG. 2 shows a conventional support frame device 2 including a base mounting plate 21 that has an intermediate portion punched to form a substantially U-shaped spacer plate 22 with an integrally formed downwardly extending hollow stem 23 for retaining therein an upright post 24. Although the need to weld the hollow stem 23 to the spacer plate 22 and the associated problem are eliminated, the entire support frame device 2 has to be made of a metal material of preferred strength, which results in increased material costs.

FIG. 3 shows a conventional support frame device 3 that has a spacer plate 32 pivotally mounted to a bottom portion of a base mounting plate 31, the spacer plate 32 having a bottom portion formed with an opening for receiving a hollow stem portion 33 of a post mounting member. The post mounting member has a square base 331 secured to the bottom portion of the spacer plate 32 through the use of rivets 332 at the four corners. In this construction, although it is only necessary to have the post mounting member to be formed from a metal material of a preferred strength or greater thickness, the riveting process is troublesome.

SUMMARY OF THE INVENTION

Therefore, the object of the present invention is to provide a support frame device for connecting a seat portion to an upright post, which eliminates the aforesaid drawbacks.

Accordingly, a support frame device for connecting a seat portion to an upright post of the present invention includes an anchoring member, an anchored member, a securing member, an annular stiffening member, and a connecting member. The anchoring member includes a base mounting plate with first right and left sides opposite to each other in a transverse direction and adapted to be mounted beneath the seat portion. Right and left anchoring plates are integrally formed with, and respectively extend from the first right and left sides of the base mounting plate in an axial direction and away from the seat portion. The anchored member includes a spacer plate with second right and left sides opposite to each other in the transverse direction, and upper and lower walls opposite to each other in the axial direction. The upper and lower walls include upper and lower peripheral edge portions, respectively, which cooperate to confine a mounting bore that defines an axis parallel to the axial direction. Right and left anchored plates are integrally formed with, and respectively extend from the second right and left sides of the spacer plate in the axial direction and away from the lower wall. The securing member is disposed to secure the right and left anchored plates respectively to the right and left anchoring plates such that the upper wall of the spacer plate cooperates with the base mounting plate to define an accommodation space in the axial direction. The stiffening member has an annular abutment end disposed to abut against the lower peripheral edge portion, and an annular seat end opposite to the annular abutment end and distal to the lower peripheral edge portion. The annular seat end cooperates with the annular abutment end to define an axial passage adapted to allow the upper end of the upright post to pass through. The connecting member includes a hollow stem having lower and upper annular ends opposite to each other in the axial direction, and an inner annular wall extending from the lower annular end to the upper annular end to confine an axial through hole adapted to permit the upper end of the upright post to move retainingly therein relative to the inner annular wall in the axial direction. A flange portion is integrally formed with, and extends from the upper annular end in radial directions. The flange portion abuts against the upper peripheral edge portion when the hollow stem is inserted into the mounting bore with the lower annular end thereof extended through the axial passage and downwardly of the annular seat end. The lower annular end is malleated to form an outwardly and radially extending flared portion that abuts against the annular seat end.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
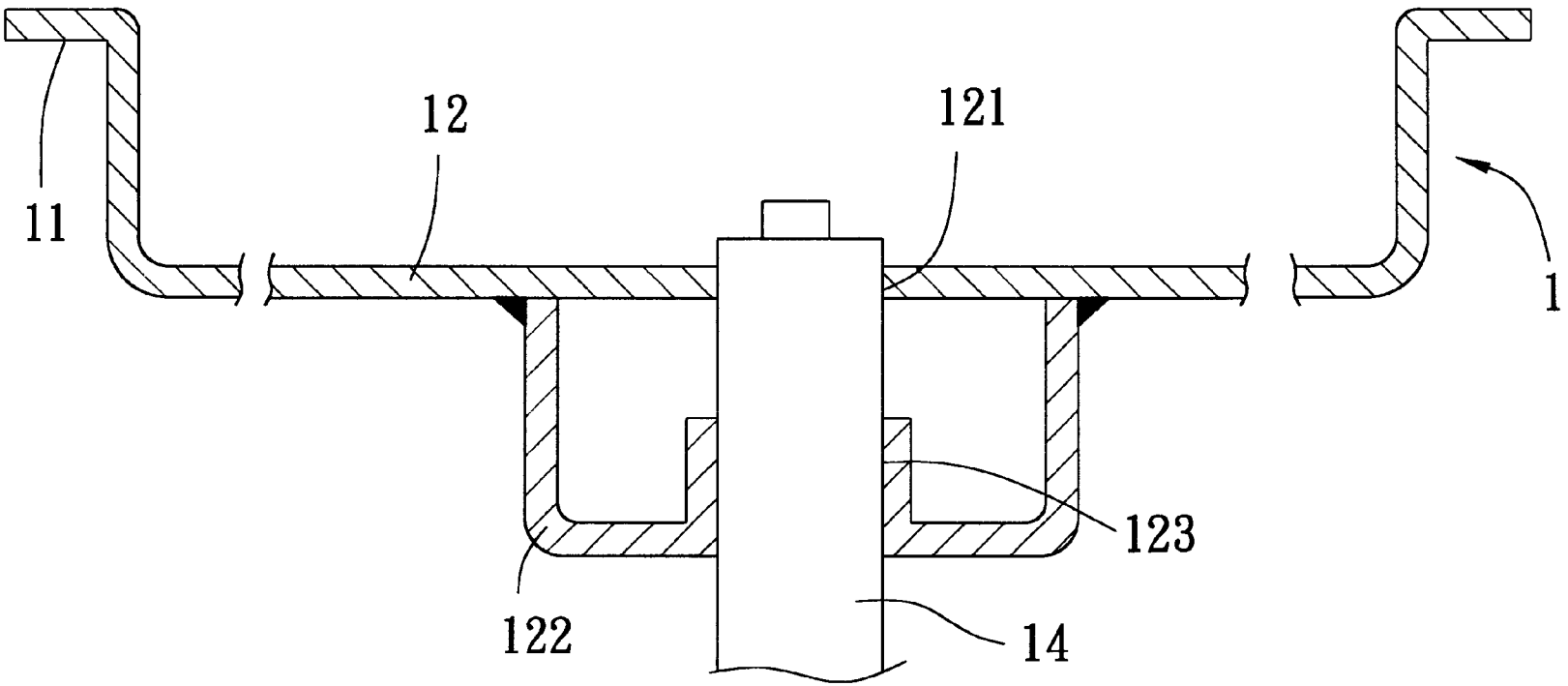
FIG. 1 PRIOR ART
FIG. 1 is a schematic partly sectional view of a conventional support frame device, in which a post mounting member is welded to a spacer plate of a base mounting plate.
Figure 2:
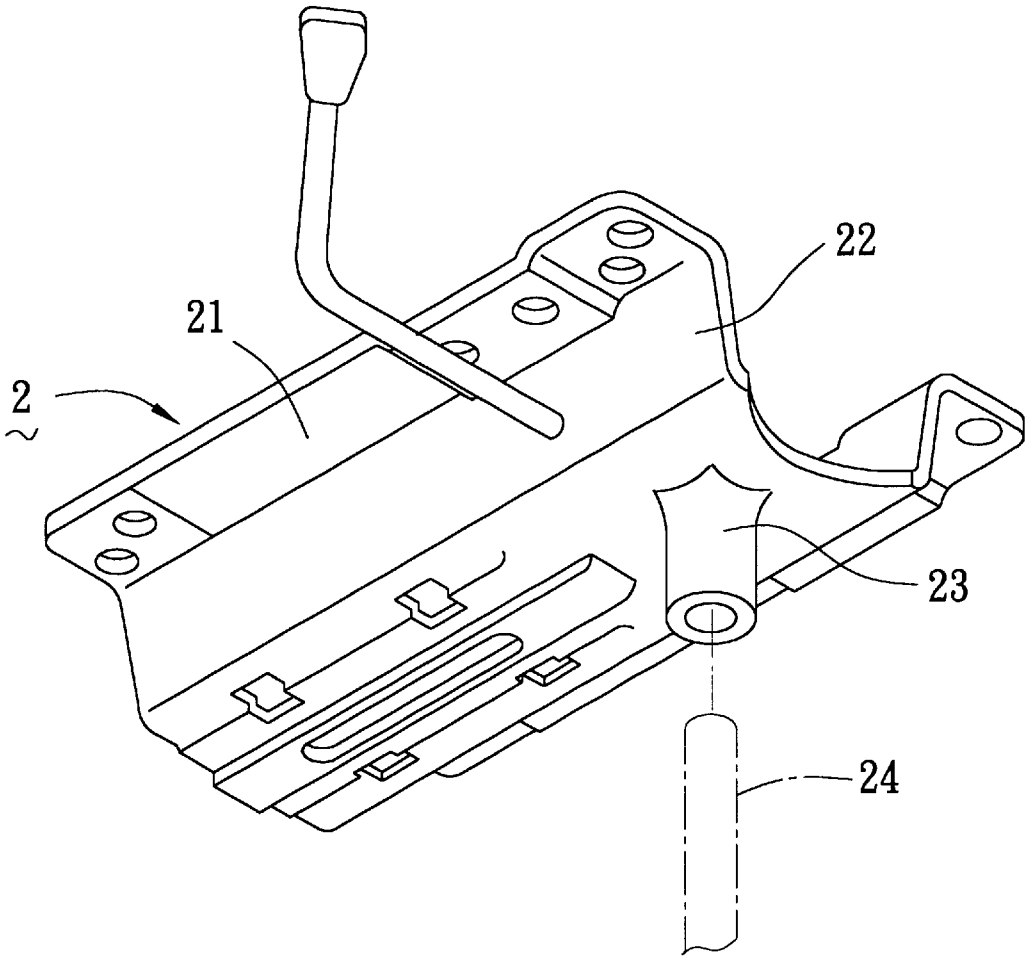
FIG. 2 PRIOR ART
FIG. 2 is a perspective view of another conventional support frame device, in which a base mounting plate is integrally formed with a hollow stem for mounting of an upright post.
Figure 3:
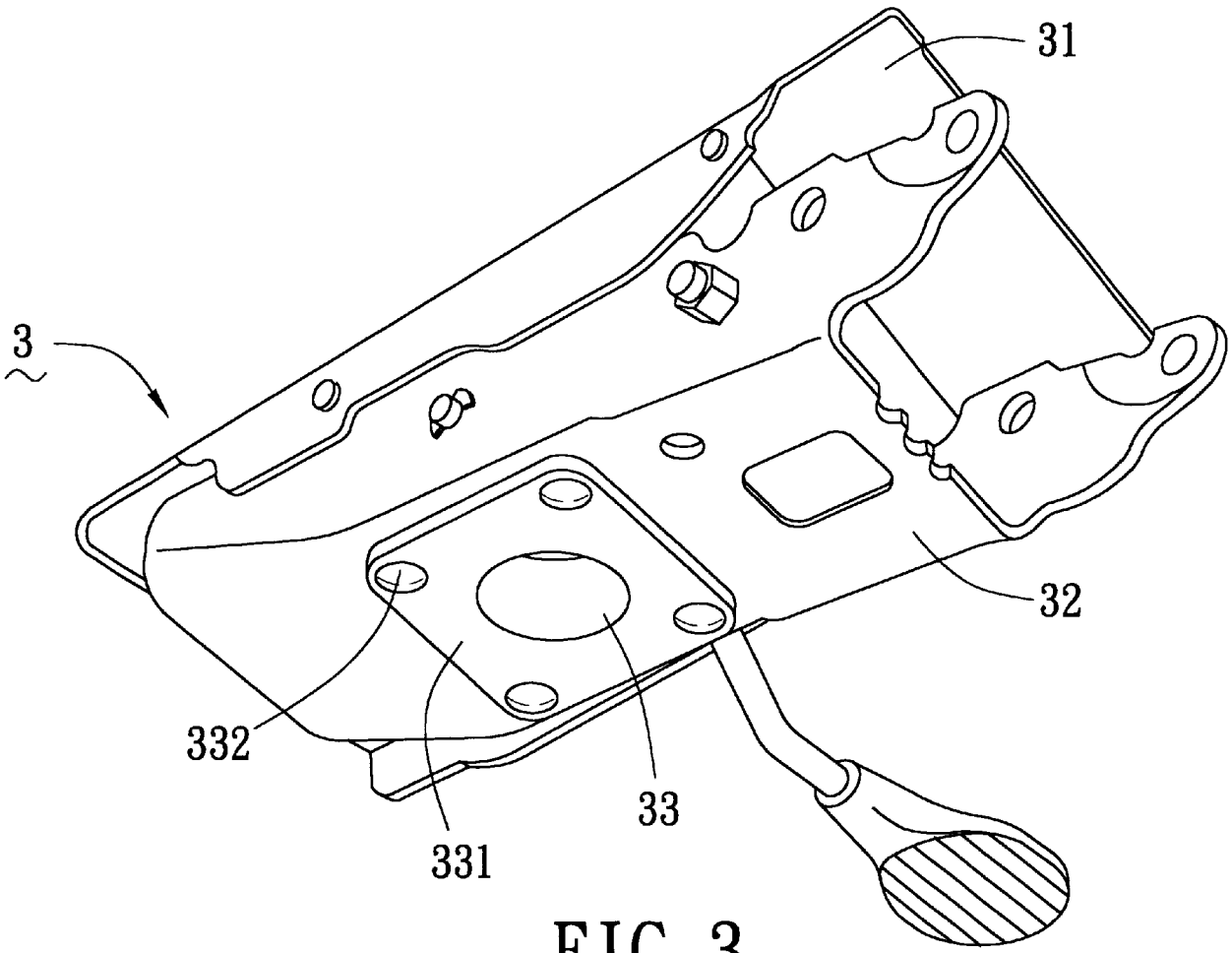
FIG. 3 PRIOR ART
FIG. 3 is a perspective view of yet another conventional support frame device, in which a post mounting member is riveted to a spacer plate of a base mounting plate.
Figure 4:
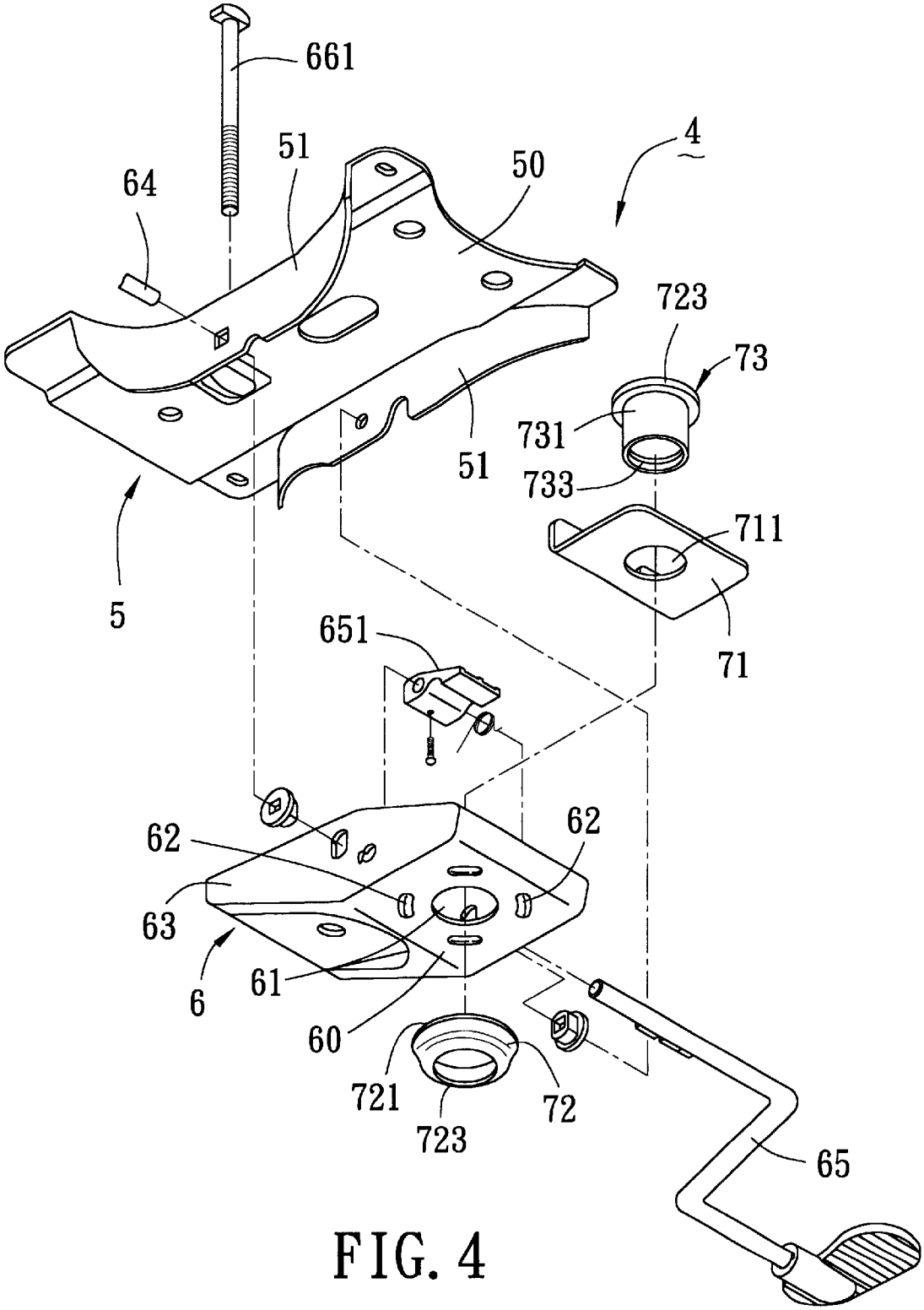
FIG. 4 is an exploded bottom perspective view of a preferred embodiment of a support frame device for connecting a seat portion to an upright post according to the present invention.
Figure 5:
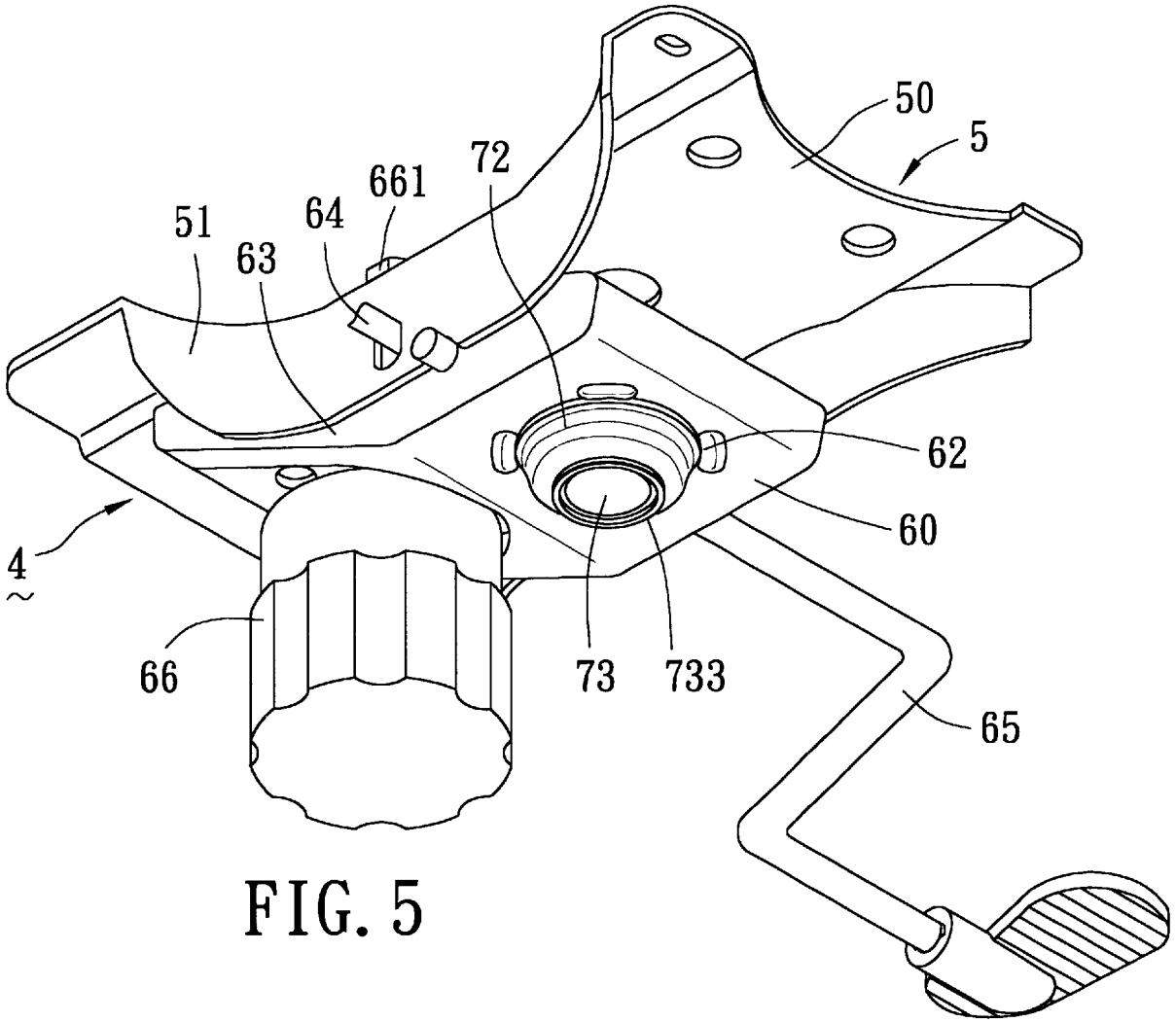
FIG. 5 is a bottom perspective view of the preferred embodiment in an assembled state.
Figure 6:
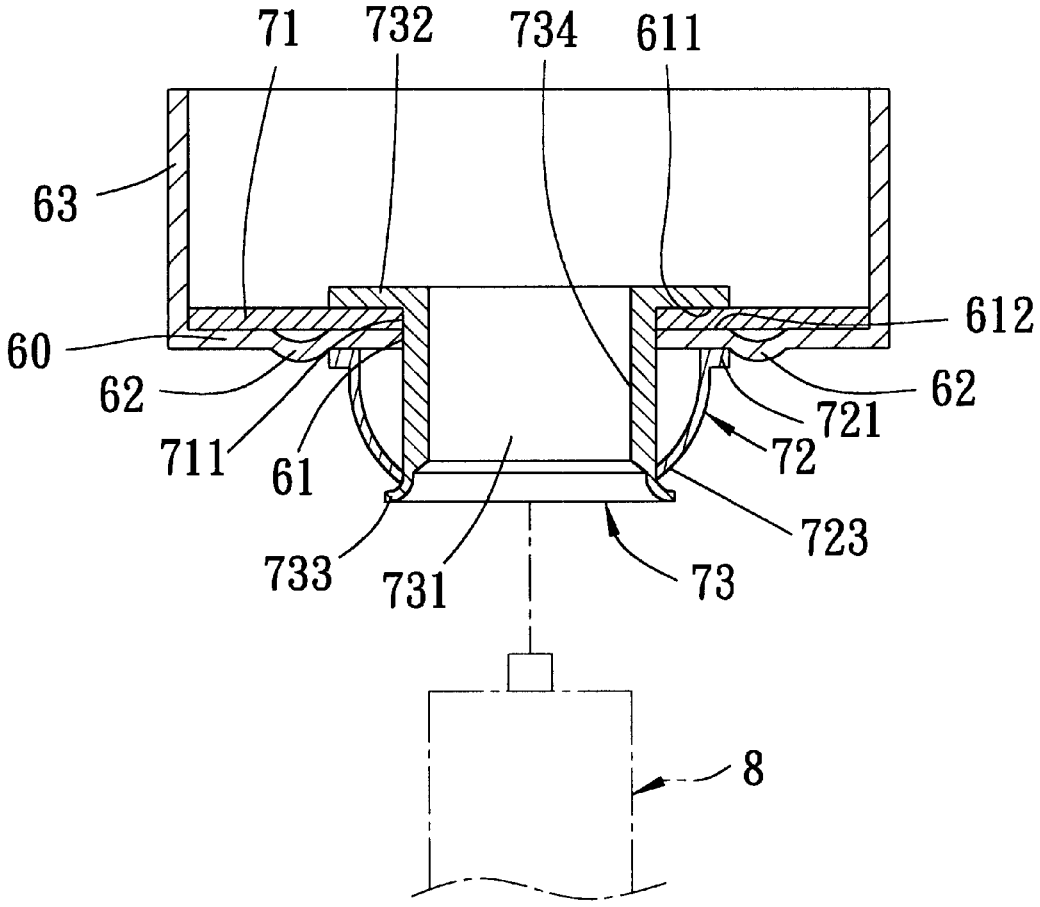
FIG. 6 is a schematic partly sectional view of the preferred embodiment in an assembled state.

Referring to FIGS. 4, 5 and 6, the preferred embodiment of a support frame device 4 for connecting a seat portion of a chair (not shown) to an upright post 8 according to the present invention is shown to include an anchoring member 5, an anchored member 6, a securing member 64, an annular stiffening member 72, and a connecting member 73.

The anchoring member 5 is formed from a metal material, and includes a base mounting plate 50 with first right and left sides opposite to each other in a transverse direction and adapted to be mounted beneath the seat portion (not shown). Right and left anchoring plates 51 are integrally formed with, and respectively extend from the first right and left sides of the base mounting plate 50 in an axial direction and away from the seat portion.

The anchored member 6 includes a spacer plate 60 having second right and left sides opposite to each other in the transverse direction, and upper and lower walls opposite to each other in the axial direction. The upper and lower walls include upper and lower peripheral edge portions 611, 612, respectively, which cooperate to confine a mounting bore 61 that defines an axis parallel to the axial direction. Right and left anchored plates 63 are integrally formed with, and respectively extend from the second right and left sides of the spacer plate 60 in the axial direction and away from the lower wall.

The securing member 64 is disposed to secure the right and left anchored plates 63 respectively to the right and left anchoring plates 51 such that the upper wall of the spacer plate 60 cooperates with the base mounting plate 50 to define an accommodation space in the axial direction.

The accommodation space is adapted for receiving a press block 651 adapted to abut against a control valve (not shown) of a pneumatic rod (not shown) so as to control extension or retraction of the pneumatic rod. The press block 651 is secured pivotally to a lever member 65 that is extended through the right and left anchored plates 63. The lever member 65 has an operating end projecting from one of the right and left anchored plates 63 for manipulation by the user. A spring mounting seat 66 is further disposed on the lower wall of the spacer plate 60. A threaded rod 661 passes through the base mounting plate 50 and the spacer plate 60, with a lower threaded section thereof engaging a central portion of the spring mounting seat 66 so as to secure the spring mounting seat 66 on the lower wall. As the aforementioned is known in the art and is not a characterizing feature of the present invention, a detailed description thereof is dispensed with herein.

The annular stiffening member 72 has an annular abutment end 721 disposed to abut against the lower peripheral edge portion 612 of the spacer plate 60, and an annular seat end 723 opposite to the annular abutment end 721 and distal to the lower peripheral edge portion 612. The annular seat end 723 cooperates with the annular abutment end 721 to define an axial passage adapted to allow the upper end of an upright post 8 (see FIG. 6) to pass through.

The connecting member 73 includes a hollow stem 731 and a flange portion 732. The hollow stem 731 has lower and upper annular ends opposite to each other in the axial direction, and an inner annular wall 734 extending from the lower annular end to the upper annular end to confine an axial through hole adapted to permit the upper end of the upright post 8 to move retainingly therein relative to the inner annular wall 734 in the axial direction. The lower annular end has a malleable portion 733 of a reduced thickness. The flange portion 732 is integrally formed with, and extends from the upper annular end in radial directions. The flange portion 732 abuts against the upper peripheral edge portion 611 of the spacer plate 60 when the hollow stem 731 is inserted into the mounting bore 61 with the lower annular end thereof extended through the axial passage and downwardly of the annular seat end 723. The malleable portion 733 is malleated to form an outwardly and radially extending flared portion that abuts against the annular seat end 723 such that the hollow stem 731 and the annular stiffening member 72 engage each other intimately.

The support frame device further includes an reinforcing plate 71 having a central hole 711 to sleeve on the hollow stem 731 so as to be sandwiched between the flange portion 732 and the upper peripheral edge portion 611 of the spacer plate 60.

In addition, a plurality of angularly spaced barrier members 62 may be disposed on the lower wall of the spacer plate 60. Preferably, the barrier members 62 are bosses that protrude downwardly from the lower wall, and that are formed by punching the spacer plate 60. Each barrier member 62 abuts against the annular abutment end 721 in a respective one of the radial directions so as to prevent outward and radial shifting of the annular abutment end 721 when the lower annular end of the hollow stem 731 is being malleated against the annular seat end 723.

It can be appreciated from the foregoing that the present invention has the following advantages:

1. As it is only necessary to hammer the malleable portion 733 against the annular seat end 723 in order to couple the hollow stem 731 with the annular stiffening member 72, assembly is quick and convenient.
2. When the upright post 8 is retained in the hollow stem 731, the load borne by the connecting member 73 can be distributed upwardly via the annular seat end 723 to where the annular abutment end 721 abuts against the lower wall of the spacer plate 60 to reduce the concentration of stress. In addition, the intimate engagement between the connecting member 73 and the annular stiffening member 72 and the arrangement of the barriers 62 combine to prevent undesirable displacement of the annular stiffening member 72 so as to help brace the vertical structure of the connecting member 73 and hence the structural strength of the support frame device 4. As such, the support frame device 4 is more durable and can better withstand shear forces generated by loads borne thereby.
3. In terms of materials savings, only the connecting member 73 and the annular stiffening member 72 need to be formed from metal material of a preferred strength. The rest of the structural elements of the support frame device 4 can be formed from ordinary metal materials.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A support frame device for connecting a seat portion of a chair to an upper end of an upright post, comprising:

an anchoring member including:

a base mounting plate with first right and left sides opposite to each other in a transverse direction, and adapted to be mounted beneath the seat portion, and right and left anchoring plates integrally formed with, and respectively extending from said first right and left sides of said base mounting plate in an axial direction and away from the seat portion;

an anchored member including a spacer plate having second right and left sides opposite to each other in the transverse direction, and upper and lower walls opposite to each other in the axial direction, said upper and lower walls including upper and lower peripheral edge portions, respectively, which cooperate to confine a mounting bore that defines an axis parallel to the axial direction, and right and left anchored plates integrally formed with, and respectively extending from said second right and left sides of said spacer plate in the axial direction and away from said lower wall;

a securing member disposed to secure said right and left anchored plates respectively to said right and left anchoring plates such that said upper wall of said spacer plate cooperates with said base mounting plate to define an accommodation space in the axial direction;

an annular stiffening member having an annular abutment end disposed to abut against said lower peripheral edge portion, and an annular seat end opposite to said annular abutment end and distal to said lower peripheral edge portion, said annular seat end cooperating with said annular abutment end to define an axial passage adapted to allow the upper end of the upright post to pass through; and a connecting member including a hollow stem having lower and upper annular ends opposite to each other in the axial direction, and an inner annular wall extending from said lower annular end to said upper annular end to confine an axial through hole adapted to permit the upper end of the post to move retainingly therein relative to said inner annular wall in the axial direction, and a flange portion integrally formed with and extending from said upper annular end in radial directions, said flange portion abutting against said upper peripheral edge portion when said hollow stem is inserted into said mounting bore with said lower annular end thereof extended through said axial passage and downwardly of said annular seat end, and subsequently malleated to form an outwardly and radially extending flared portion that abuts against said annular seat end.

2. A support frame device according to claim 1, further comprising an reinforcing plate having a central hole to sleeve on said hollow stem so as to be sandwiched between said flange portion and said upper peripheral edge portion.

3. A support frame device according to claim 1, further comprising a plurality of barrier members disposed on said lower wall, and angularly spaced apart from one another, each abutting against said annular abutment end in a respective one of the radial directions so as to prevent outward and radial shifting of said annular abutment end when said lower annular end is being malleated against said annular seat end.

4. A support frame device for connecting a seat portion of a chair to an upper end of an upright post, comprising:

a base mounting plate with first right and left sides opposite to each other in a transverse direction, and adapted to be mounted beneath the seat portion;

an anchored member including a spacer plate having second right and left sides opposite to each other in the transverse direction, and upper and lower walls opposite to each other in an axial direction, said upper and lower walls including upper and lower peripheral edge portions, respectively, which cooperate to confine a mounting bore that defines an axis parallel to the axial direction, and right and left anchored plates integrally formed with, and respectively extending from said second right and left sides of said spacer plate in the axial direction and away from said lower wall;

a securing member disposed to secure said right and left anchored plates respectively to said first right and left sides of said base mounting plate such that said upper wall of said spacer plate cooperates with said base mounting plate to define an accommodation space in the axial direction;

an annular stiffening member having an annular abutment end disposed to abut against said lower peripheral edge portion, and an annular seat end opposite to said annular abutment end and distal to said lower peripheral edge portion, said annular seat end cooperating with said annular abutment end to define an axial passage adapted to allow the upper end of the upright post to pass through; and a connecting member including a hollow stem having lower and upper annular ends opposite to each other in the axial direction, and an inner annular wall extending from said lower annular end to said upper annular end to confine an axial through hole adapted to permit the upper end of the post to move retainingly therein relative to said inner annular wall in the axial direction, and a flange portion integrally formed with and extending from said upper annular end in radial directions, said flange portion abutting against said upper peripheral edge portion when said hollow stem is inserted into said mounting bore with said lower annular end thereof extended through said axial passage and downwardly of said annular seat end, and subsequently malleated to form an outwardly and radially extending flared portion that abuts against said annular seat end.

* * * * *